US005209158A

United States Patent [19]

Salete

[11] Patent Number: 5,209,158

[45] Date of Patent: May 11, 1993

[54] GRAIN CLEANING AND POLISHING MACHINE

[76] Inventor: Felipe Salete, Av.Año de Juarez No. 198, Col. Granjas San Antonio, Iztapalapa, 09070, Mexico

[21] Appl. No.: 933,074

[22] Filed: Aug. 21, 1992

[51] Int. Cl.[5] ..... B02B 3/00; B02B 3/04; B02B 3/06

[52] U.S. Cl. ..... 99/519; 99/521; 99/528; 99/606; 99/615; 99/617

[58] Field of Search ..... 99/518-520, 99/521, 522, 524, 525, 528, 600-602, 605-608, 609, 612-615, 617, 620, 622; 241/86.1, 88.2, 93; 426/481-483; 51/4, 22, 72 R

[56] References Cited

U.S. PATENT DOCUMENTS

| | | | |
|---|---|---|---|
| 208,241 | 9/1878 | Hills | 99/615 |
| 210,029 | 11/1878 | Harris | 99/615 |
| 252,048 | 1/1882 | Mann | 99/614 |
| 274,002 | 3/1883 | Jurt | 99/615 |
| 294,225 | 2/1884 | Griffiths | 99/615 |
| 314,439 | 3/1885 | Dietz | 99/614 |
| 600,319 | 3/1898 | Prinz | 99/617 |
| 916,757 | 3/1909 | Muller | 99/519 |
| 1,020,377 | 3/1912 | Walker . | |
| 2,105,325 | 1/1938 | McBrady | 99/519 |
| 3,734,752 | 5/1973 | Headley | 426/481 |
| 3,960,068 | 6/1976 | Salete . | |
| 4,292,890 | 10/1981 | Salete-Garces . | |
| 4,583,455 | 4/1986 | Salete-Garces . | |
| 4,843,957 | 7/1989 | Satake | 99/605 |

FOREIGN PATENT DOCUMENTS

| | | | |
|---|---|---|---|
| 6473 | 9/1878 | Fed. Rep. of Germany | 99/519 |
| 0534245 | 11/1976 | U.S.S.R. | 99/615 |

*Primary Examiner*—Timothy F. Simone
*Attorney, Agent, or Firm*—Rothwell, Figg, Ernst & Kurz

[57] ABSTRACT

A machine for cleaning and polishing grains comprises at least one treatment chamber which includes an upper frusto conical baffle having a central opening to admit grains thereinto, an intermediate rotatory disc to impart movement to the grains falling thereon through said opening and a lower frusto conical baffle having a central opening to discharge the grains, said upper frusto conical baffle having a stationary brush and a stationary set of flexible fingers vertically hanging therefrom, and said rotatory disc having a rotatory brush and a rotatory set of flexible fingers hanging from its lower surface in a direction and to a distance suitable to confront the upper surface of said lower frusto conical baffle, whereby the grains are cleaned by the action of said stationary brush and set of fingers on the moving grains driven by the rotatory disc, and by the action of said rotatory brush and set of fingers on the grains sliding down said lower frusto conical baffle.

8 Claims, 2 Drawing Sheets

GRAIN CLEANING AND POLISHING MACHINE

FIELD OF THE INVENTION

The present invention refers to a grain cleaning and polishing machine and, more particularly, it relattes to a machine for cleaning, polishing, brightening and removing impurities and soil lumps from grains and seeds, particularly from cereal grains, without marring or affecting in any noticeable manner the surfaces thereof.

BACKGROUND OF THE INVENTION

Some different types of machines are known in the prior art either for husking; husking and cleaning; polishing and brightening; cleaning, polishing and brightening; or even for husking, cleaning, polishing and brightening grains in one single operation. However, all the prior art machines have the disadvantage of being designed as machines that exercise an energetic of being the grains with the purpose of removing husk or of polishing at least partially husked grains such as rice, with the purpose of removing the portions of husk remaining on the grains and at the same time polishing and brightening the same.

For instance, U.S. Pat. No. 1,020,377 to Walker, describes a grain cleaning machine which comprises a screen, a rotor concentrically arranged within said screen at a distance therefrom and an axially arranged and radially outwardly extending adjustable retarding blade on the rotor for regulating the movement of the grain and for determining the amount of attrition to which the grain is subjected. This machine, however, although capable of cleaning grains, is designed to exert a rather energetic action on said grains to also remove the hulls thereof and, therefore, is absolutely useless for cleaning and polishing grains without marring their surface.

U.S. Pat. No. 3,960,068 to Salete, describes and claims a machine particularly suitable for partially husking, polishing and whitening rice grains that have been previously husked in a separate machine, which essentially comprises a treatment chamber for grains that includes a cylindrical screen provided with openings designed in an arrangement that provides for a frictioning action on the grains passing therewithin, a rotor provided with a number of radially outwardly extending but axially arranged blades that are adjustable in their radial direction, and a hollow axle for supporting said rotor concentrically arranged within said screen and through which a stream or air is forced to entrain the bran and other impurities released from the grains. The grains are admitted into said chamber under a predetermined pressure and are forced by said rotor and blade to rotate within the treatment chamber and rub against each other and against said screen, which produces a very effective action for removing the husk remaining on the grains and at the same time polishes and whitens or brightens the same. This machine, however, is not capable of exerting a mild action on the grains and cannot be used to clean and polish grains without affecting their surface, because of the rather energetic rubbing action generated between the grains and the screen, effected by the energetic push of the blade of the rotor.

U.S. Pat. No. 4,292,890 to Salete describes a machine which may be regarded as an improvement over the machine of the above discussed patent and also comprises a screen that has axially directed stationary blades in the form of fluted plates arranged around the circumference of the screen, and a rotor having similarly fluted blades that are adjustable in their radial position. Although this machine carries out a more controlled action on the grains, it is nevertheless a machine designed for exercising an energetic action on the grains and also cannot be capable of cleaning and polishing grains without considerably affecting their surface.

U.S. Pat. No. 4,583,455 also to Salete, describes and claims a still more improved rotor and screen assembly for use in the machines described in the above discussed patents, but again it suffers of the same type of disadvantages as the previously described prior art machines, which renders the same incapable of carrying out a sufficiently mild action on the grains so as not to considerable affect their surface.

Some other types of machines for cleaning and polishing grains that supposedly do not considerably affect the surface thereof are known in accordance with the prior art, but said machines are only capable of carrying out one single operation, such as cleaning the grains, or polishing the same, or brightening the same, or removing impurities and lumps therefrom, whereby a considerable amount of machines have to be used for effecting the operations described above, that is, a machine for cleaning the grains, a separate machine for removing lumps therefrom, and a separate machine for polishing the grains, which in turn requires a relatively large investment in equipment, and takes a long time to effect the operations, thus considerably increasing the costs of treatment of certain grains, particularly those in which it is necessary to keep the surface thereof unaffected, such as black of brown beans, lime beams, chickpeas and the like, all of which are grains that must reach the consumer with their surfaces clean and polished but otherwise unaffected in any respect, for the sake of quality.

Up to the present time, that applicant knows, there are no machines extant in the market that may be capable, in one single cycle, of cleaning, polishing and removing impurities and soil lumps from cereal grains that must keep their surfaces otherwise unaffected, whereby for long such a machine has been sought by the workers in the art, without any satisfactory success.

OBJECTS OF THE INVENTION

Having in mind the defects of the prior art machines for cleaning, polishing and removing impurities and soil lumps from grains, it is an object of the present invention to provide a machine which will be of a very simple and economic construction and yet will be perfectly capable of cleaning, polishing and removing impurities and soil lumps from grains, all in one singe cycle of operation of the machine.

It is another object of the present invention to provide a machine of the above described character, which will be capable of carrying out said operations on the grains without otherwise affecting the surfaces thereof.

One other object of the present invention is to provide a machine of the above mentioned character, that due to its special design, will avoid the necessity of using separate machines for carrying out each operation, thus considerably reducing the investment cost of the equipment.

One other and more particular object of the present invention is to provide a machine of the above described character, which will prevent the existence of delays for discharging the grains after each operation and reloading the grains in a consecutive separate machine to effect the next operation.

A still more particular object of the present invention is to provide a machine of the above described character, which will exert moderate rubbing or polishing actions actions alternated with mild rubbing or polishing actions on the grains as said grains are forced through the machine, in order to gradually clean and polish the same without however noticeably affecting their surfaces.

SUMMARY OF THE INVENTION

The foregoing objects and others ancillary thereto are preferably accomplished as follows:

According to a preferred embodiment of the invention, the grains are treated by feeding the same into a machine which essentially comprises a vertical housing; a cylindrical screen concentrically arranged within said housing at a distance therefrom sufficient to leave an annular space therebetween; a vertical hollow shaft rotatably mounted at the central axis of said inner space defined by the screen; drive means coupled to said rotatable shaft to impart a rotational movement thereto; at least one treatment chamber arranged within the inner space defined by said screen, said at least one treatment chamber including an upper frusto conical stationary baffle provided with a central opening and having at least one stationary brush and at least one set of stationary flexible fingers vertically hanging from its lower surface, and a rotatable disc coupled and supported by said central shaft to rotate in unison therewith, said rotatable disc being arranged in a horizontal position and with its upper surface directly confronted with the lower ends of said at least one stationary brush and said at least one stationary set of flexible fingers at a short distance therefrom, the lower surface of said rotatable disc having at least one downwardly extending projection provided with downwardly and inwardly extending end brackets, one of said end brackets supporting a downwardly and outwardly extending rotatable brush and the other of said end brackets supporting a downwardly and outwardly extending rotatable set of flexible fingers; a lower or outlet frusto conical stationary baffle having a central opening and arranged such that the upper conical surface thereof is directly confronted with the lower ends of said at least one rotatable brush and said at least one rotatable set of flexible fingers at a short distance therefrom; means for feeding grains above said upper stationary baffle; means for discharging treated grains below said outlet stationary baffle; and means for forcing an air stream to circulate from the hollow shaft through perforations provided therein into the said at least one treatment chamber, through said screen and outwardly of the machine through the space between said screen and said housing.

BRIEF DESCRIPTION OF THE DRAWINGS

The novel features that are considered characteristics of the present invention are set forth with particularity in the appended claims. The invention itself, however, both as to its organization and its method of operation, together with additional objects and advantages thereof, will best be understood from the following description of a specific embodiment when read in connection with the accompanying drawings, in which:

DETAILED DESCRIPTION

Figure 1:
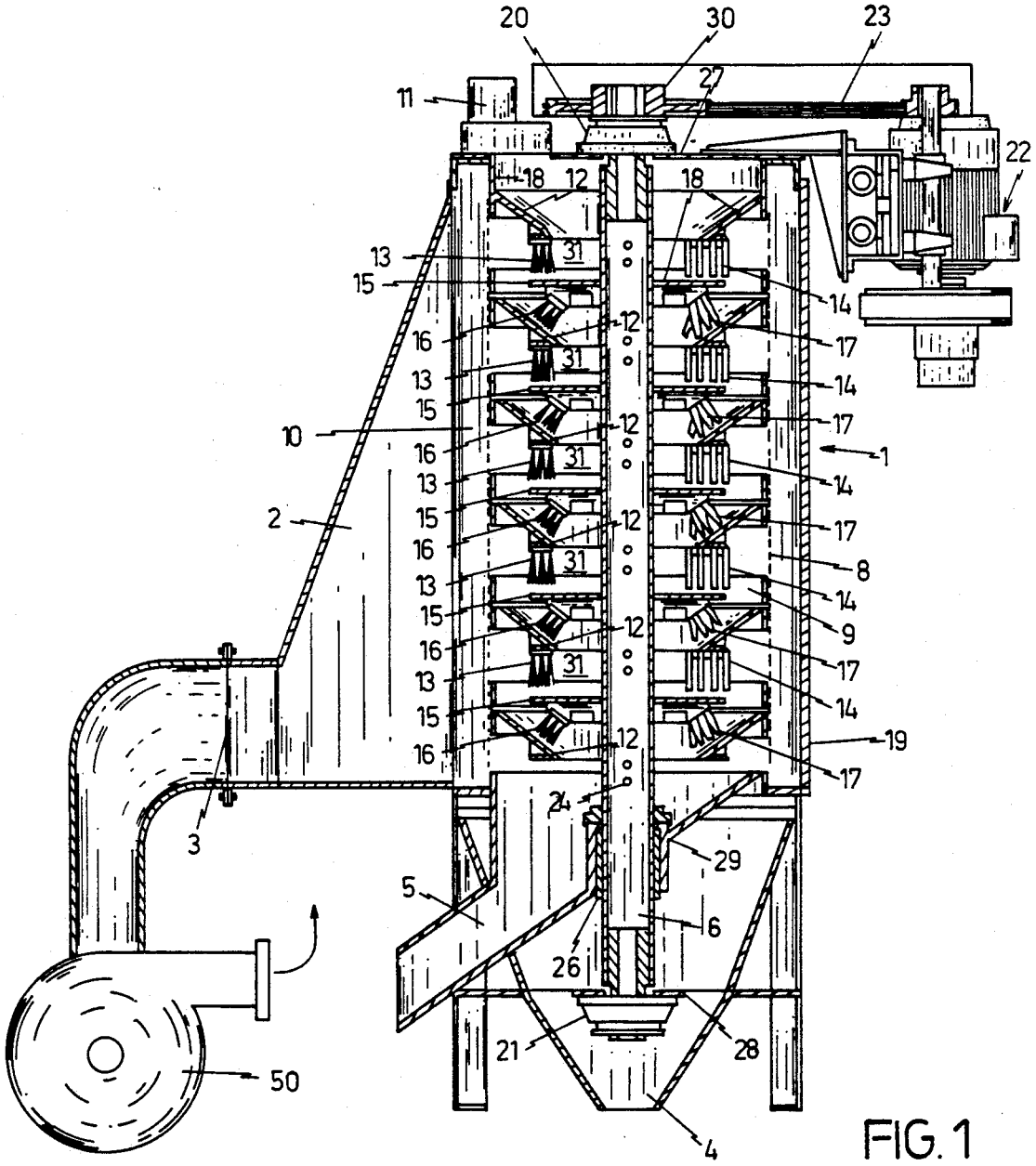
FIG. 1 is a cross sectional elevational view of a machine for cleaning and polishing grains, built in accordance with the preferred embodiment of the present invention.

Having now more particularly reference to the drawings and more specifically to FIG. 1 thereof, the machine built in accordance with the preferred embodiment of the invention comprises an outer housing 1, arranged in a vertical fashion, and a cylindrical screen 8 concentrically arranged within said housing. The cylindrical screen 8 arranged within the housing 1 comprises a plurality of openings of a predetermined size suitable for allowing the passage of dust and other light impurities removed from the grain fed to the machine, as well as of medium size impurities such as soil lumps and broken grains, as will be described hereinbelow.

The inner space encompassed by said cylindrical screen 8 is vertically divided into a plurality of treatment chambers generally designated by means of reference numeral 31, which are defined by a corresponding plurality of frusto conical baffles 12, attached to the screen 8 by suitable means and with their frusto conical walls projecting inwardly and downwardly of the inner space of the screen 8, as clearly shown in FIG. 1 of the drawings. Each frusto conical baffle 12 has a central wide circular opening as shown, in order to allow the sliding of the grains fed through the upper end of the machine, downwardly on the surface of the frusto conical walls of said baffles, throughout the total number of treatment chambers provided therein.

Each frusto conical baffle 12 is provided with at least one brush 13 and with at least one diametrically opposed set of fingers or flexible straps 14 made of a flexible material such as rawhide or the like, for a purpose which will be more clearly described when defining the operation of the machine.

Figure 2:
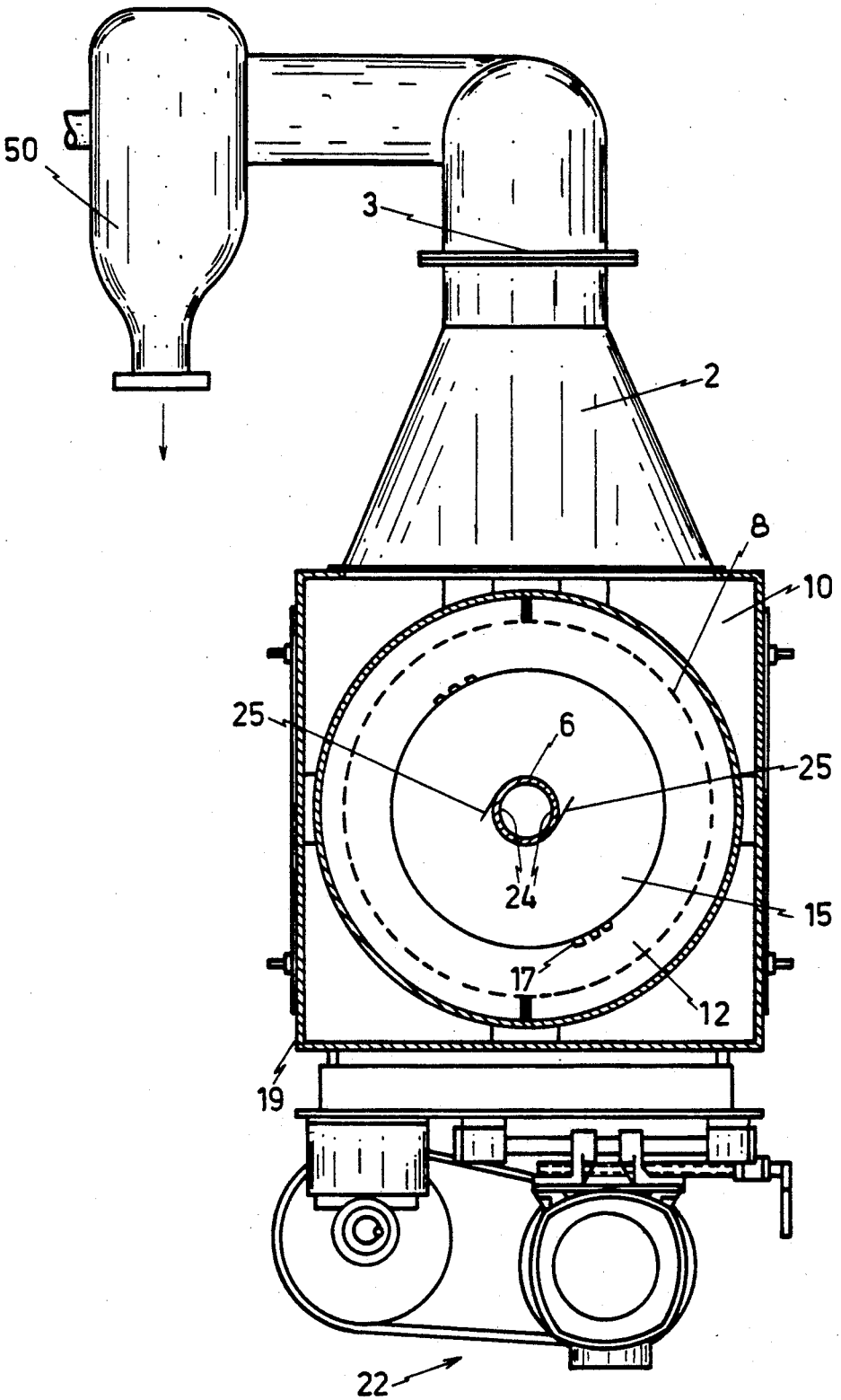
FIG. 2 is a plan view of the machine shown in FIG. 1, with certain parts of the outer housing partially cutaway in order to show inner details thereof.

At the center of the inner space defined by screen 8, a hollow shaft or axle 6 is mounted on suitable journals, such as upper journal 20 supported on the upper wall 27 or top of the housing 1, intermediate journal 26 supported on a suitable support 29 which in turn is attached to a sufficiently resistant part of the machine, and a lower journal 21 supported on the lower surface of the bottom 28 of the machine. The hollow axle 6 is provided with a plurality of openings distributed along the circumference of the axle, and indicated in general by means of reference numeral 24, with at least one set of openings coinciding with the center of each treatment chamber 31 along the height of the axle 6, as clearly shown in FIG. 1 of the drawings. Said openings are covered by means of corresponding flexible lids 25 as shown in FIG. 2 of the drawings, which prevent the entrance, through the openings or bores 24, of grain or impurities generated by the operation of the machine.

Intermediate each pair of frusto conical baffles 12, corresponding discs 15 are mounted on the axle or shaft 6, in order to rotate in unison therewith, said discs having a downwardly directed projection which in turn supports at least 1 brush 16 and at least one set of flexible straps or fingers 17, made of a material similar to that described for the fingers 14, so that said brushes 16 and sets of fingers 17 are rotated by means of the discs 15, when the latter are rotated by the central shaft 6.

Shaft 6 is connected to a motor or the like 22, by means of suitable pulleys such as pulley 30 and belts 23 as very clearly shown in both figures of the drawings.

The upper cover or top 27 of the housing 1, is provided with an inlet 11 for feeding grain to be treated within the machine, and the side wall of housing 1 is provided with an outlet hood 2, communicated by means of outlet 3 to an air suction device 50, which drives air from the atmosphere into the lower end of hollow shaft 6, pulls air out of the hollow shaft 6 through the bores 24 in order to be forcedly circulated in each treatment chamber 31, then through the openings of the screen 8, and between said screen and the housing 1 out of the machine through the outlet belt 2 and outlet 3.

At the lower portion of housing 1, a suitable conical hopper having an outwardly and downwardly extending outlet chute 5 is provided, in order to collect the finished grains falling by gravity through chambers 31 to the bottom of screen 8, in order to transfer said finished grain by gravity out of the machine.

Downwardly of the machine, and attached to the bottom of the side walls 19 of housing 1, there is a conical or pyramidal outlet 4, which collects and transfers out of the machine all the materials that fall down through the space provided between the housing 1 and the screen 8 and that are not entrained by the air stream exiting the machine through hood 2 and outlet 3.

The surfaces of the various elements of the machine that are more likely to receive grain at high velocity, are preferably covered with a soft but harsh flexible material such as rawhide, in order to avoid violent impacts of the grain against said surfaces which would produce undesirable breakage of the grain. Preferably the upper surfaces of the frusto conical baffles 12 and the upper surfaces of the rotating discs 15, generally indicated by means of reference numeral 18, are provided with a lining of such a material, although the lining itself has not been illustrated in the figure for the sake of simplicity. The screen is also provided with a plurality of cylindrical straps 9 made of the same material, and said straps are located at those portions of the screen where the grains may impact the same more violently, after being thrown centrifugally away from the center of the machine and against the screen 8 by the rotating discs 15 and by the braking action of the brushes 13 and sets of fingers 14. This cylindrical straps of rawhide 9, of course, only partially cover the surface of the screen 8, in view of the fact that most of said surface most be left free for passage of material through the openings thereof as will be clearly understood by anyone skilled in the art.

The outer housing 1 may be of any desirable shape, such as the square cross sectional shape shown in FIG. 2 of the drawings which represents one of the preferred embodiments of the invention, but said housing 1 may also be of a cylindrical shape, in order to provide a uniform annular space 10 through which the light materials will be entrained by the air outwardly of the machine through the hood 2 and outlet 3.

The lids 25 which partially cover the bores 24 provided at each treatment chamber through the wall of the hollow shaft 6, as more clearly shown in FIG. 2 of the drawings, are attached only at one end thereof, so that the openings 24 of the hollow axle 6 may remain open during the operation of the machine, by the bending of said flexible lids 25 by the action of the centrifugal force produced by the rotation of shaft 6, and the flexibility of said lids 25, which are also normally made of rawhide or the like, prevents the accidental entrance of particles from the treatment chambers into the hollow space of shaft 6, because when said impurities strike on the outer surfaces of said lids 25, they will tend to cover the openings or bores 24 and prevent the entrance of large particles therethrough.

The motor 22 is preferably a variable speed unit, in order to provide the shaft 6 with a rotating velocity which is consistent with the nature of the grains fed to the machine and with the energy desired of the treatment which is to be effected on said grains.

Although the machine of the present invention may be used to clean and polish numerous different types of grains or seeds, it is highly preferred for the treatment of beans, chickpeas, lima beans and the like, which require a good quality on the outer surface thereof, without any dirt and, however, without any marring of said surfaces, as those normally generated by the action of hard rolls or the like, as previously used for these purposes in the machines of the prior art.

The operation of the machine built in accordance with the preferred embodiment of the invention as described above and as shown in FIGS. 1 and 2 of the drawings is as follows:

The grain to be treated is fed to the machine through the top inlet 11, in order to be allowed to fall by gravity on the frusto conical surface of the first stationary frusto conical baffle 12 which is supported on the top 27 of the machine as shown in FIG. 1 of the drawings. The grain slides down the inwardly and downwardly directed inclined surface formed by the first frusto conical baffle 12, and falls on top of the first rotating disc 15, which drives the grains falling thereon, with a spiral movement which tends to throw them against the screen 8, finding in its way the brush or brushes 13 which exert a cleaning action on the surfaces of said grains, and also against the set or sets of flexible straps or fingers 14, which exert a mild rubbing action on the grains, thus polishing the same.

The light materials released from the surfaces of the grains by means of brushes 13, are entrained in the air circulating through the treatment chamber 31, which air is admitted, as described above, in the hollow space of the shaft 6 and through the bores 24 thereof, so that said stream of air with the entrained light particles, is forced outwardly of the screen 8, and is suctioned outwardly of the machine through the collecting hood 2 an outlet 3 clearly shown in FIGS. 1 and 2 of the drawings. The medium sized materials that are released from the grain but that are not sufficiently light to be entrained by the stream of air, fall down through the hollow space 10 to be taken out of the machine through outlet 4. The heavier materials, such as broken grain and other large materials that do not pass through the openings of screen 8, fall down by gravity after bouncing against the soft cylindrical straps 9 provided on the screen and against the screen 8 itself, together with the whole partially cleaned and polished grains, and slide downwardly of the inclined surface formed by the second frusto conical baffle 12, and on their way down, fastly moving because of the velocity imparted by upper rotating disc 15, are actuated upon by the rotatory brush 16 and the rotatory set of fingers 17, which furtherly clean the surfaces thereof by the action of said brush 16 and polish the same by the rubbing action of said flexible fingers 17. The grains thrown outwardly of the central axis of the machine by means of the first rotating disc 15, as clearly shown in FIG. 1 of the drawings, are impacted against the soft portion constituted by the flexible strap 9, thus preventing in a large percentage, the breakage of the grains. As mentioned above, the few broken grains originating in the first treatment chamber 31, are conducted downwardly of the machine through the second chamber 31, together with the whole grains.

The cycle is repeated on the second chamber 31, because the grains and broken grains fall on the second rotating disc 15, which again pushes the grains against the stationary brushes 13 and the stationary sets of fingers 14, repeating the cycle described above for the first treatment chamber. The broken grains, however, are normally reduced in size such that they ultimately pass through the screen 8 and fall down the space 10 to be collected in the hopper 4. The fully treated grain, in turn, is discharged by the lowest or discharge frusto conical baffle 12 into the hopper and chute 5 to be taken out of the machine as finished product.

It may be concluded from the above that, depending on the nature of the grain and on the type of action desired to be exercised thereon, any number of treatment chambers may be included within the space defined by screen 8, whereby one single treatment chamber 31 will be effective for cleaning and polishing grains that do not require an energetic action, whereas if a more energetic action is required, the number of treatment chambers that are to be included in the machine may be increased as necessary. Also, the energy of the treatment very much depends in a direct relationship from the speed of rotation of the discs 15, whereby the combination of the number of chambers 31 and of the speed of rotation of the shaft 6, are the parameters to be considered for the treatment of a specific type of grain and for the type of desired treatment to be exercised thereon by the machine.

In view of the above, anyone skilled in the art will clearly understand that the machine is not restricted to a specific number of treatment chambers and that said machine may contain only one of said chambers or any number thereof as may be necessary.

As already briefly mentioned above, after falling down the last frusto conical baffle 12 as shown in FIG. 1 of the drawings, the broken grains should have already been reduced to a size such that they will pass through the openings of the screen 8, but will not be entrained by the stream of air outwardly of the collecting hood 2 and outlet 3, whereby they will fall down the space 10 formed between the housing 1 and the screen 8, and will be collected in hopper 4, to be taken out of the machine.

The whole grain already fully cleaned by means of the stationary sets of brushes 13 and the rotating sets of brushes 16, and fully polished by means of the stationary sets of fingers 14 and the rotating sets of fingers 17, will slide down the last frusto conical baffle 12, and will be collected in hopper 5, to be taken out of the machine as the finished product thereof.

As it can be clearly seen, the operation of the cleaning and polishing machine of the present invention is very simple, because the grain will be moved through the machine by gravity and three different discharges are obtained from this machine, namely, a discharge of light impurities such as dust, bran and the like, which are entrained by means of the forced air stream and taken out of the machine through outlet 3, a second discharge of intermediate sized impurities which are sufficiently heavy not to be fully entrained by the forced air stream and which therefore fall down the hollow space 10 and are collected in hopper 4 to be taken out of the machine and finally, a third discharge consisting of the fully polished and cleaned grain, which will fall down the treatment chambers 31 of the machine and will be collected by the central hopper and chute 5 to be taken out of the machine as the fully finished product thereof.

It may be seen from the above that the discharge of the product from the machine built in accordance with the preferred embodiment of the present invention described above, is very simple and does not require of auxiliary discharging devices, inasmuch as the product flows by gravity without the need of such auxiliary devices. On the other hand, the construction of the apparatus for providing the above described treatment system, is very simple and economical as will be apparent to anyone skilled in the art, and it must be understood that the embodiment of the invention illustrated and described above is merely illustrative but not limitative of the present invention, because the equipment may be modified in the details thereof, such as for instance, by adding treatment chambers to the machine by the provision of additional fixed frusto conical baffles and rotatory discs, or the number and position of the brushes and sets of flexible fingers in each treatment chamber may also be varied at will, depending on the nature of the treatment, without thereby departing from the spirit of the desired invention.

Although certain specific embodiments of the invention have been shown and described above, it is to be understood that many modifications thereof are possible. The present invention, therefore, is not to be restricted except insofar as is necessitated by the prior art and by the spirit of the appended claims.

What is claimed is:

1. A grain cleaning and polishing machine which comprises a vertical housing; a cylindrical screen concentrically arranged within said housing at a distance therefrom sufficient to leave an annular space therebetween; a vertical hollow shaft rotatably mounted at the central axis of said inner space defined by the screen; drive means coupled to said rotatable shaft to impart a rotational movement thereto; at least one treatment chamber arranged within the inner space defined by said screen, said at least one treatment chamber including an upper frusto conical stationary baffle provided with a central opening and having at least one stationary brush and at least one set of stationary flexible fingers vertically hanging from its lower surface, and a rotatable disc coupled and supported by said central shaft to rotate in unison therewith, said rotatable disc being arranged in a horizontal position and with its upper surface directly confronted with the lower ends of said at least one stationary brush and said at least one stationary set of flexible fingers at a short distance therefrom, the lower surface of said rotatable disc having at least one downwardly extending projection provided with downwardly and inwardly extending end brackets, one of said end brackets supporting a downwardly and outwardly extending rotatable brush and the other of said end brackets supporting a downwardly and outwardly extending rotatable set of flexible fingers; a lower or outlet frusto conical stationary baffle having a central opening and arranged such that the upper conical surface thereof is directly confronted with the lower ends of said at least one rotatable brush and said at least one rotatable set of flexible fingers at a short distance therefrom; means for feeding grains above said upper stationary baffle; means for discharging treated grains below said outlet stationary baffle; and means for forcing an air stream to circulate from the hollow shaft through perforations provided therein into the said at least one treatment chamber, through said screen and outwardly of the machine through the space between said screen and said housing.

2. A grain cleaning and polishing machine according to claim 1 wherein a plurality of said treatment chambers is vertically arranged one below the other within the space defined by said screen, said stationary frusto conical outlet baffle being arranged below the lowest one of said plurality of treatment chambers.

3. A grain cleaning and polishing machine according to claim 2 wherein a collecting hood is provided at the side wall of said housing for collecting the air circulated through the machine and entrained light impurities removed from the grain, a collecting hopper is provided at the bottom of said screen for collecting treated grain, and a waste collecting hopper is provided at the bottom of said housing in order to collect medium size impurities that were not entrained by the forced air stream circulated through the machine.

4. A grain cleaning and polishing machine according to claim 1 wherein said sets of flexible fingers are elongated flat straps of rawhide.

5. A grain cleaning and polishing machine according to claim 4 wherein the upper surfaces of said stationary baffles and of said rotatable discs, as well as the outer surface of said shaft are lined with a soft but harsh lining material in order to prevent violent impacts of the grain against hard metal surfaces so as to reduce the rate of breakage of the grains.

6. A grain cleaning and polishing machine according to claim 5 wherein said lining material is rawhide.

7. A grain cleaning and polishing machine according to claim 1 wherein said perforations in the hollow shaft for air circulation are provided with outer flexible lids hinged at one end on the surface of said shaft, in order to prevent solid materials to be back-fed into the hollow space of said hollow shaft.

8. A grain cleaning and polishing machine according to claim 1 wherein said drive means is a variable speed drive means.

* * * * *